US008371133B2

(12) United States Patent
Kim et al.

(10) Patent No.: US 8,371,133 B2
(45) Date of Patent: Feb. 12, 2013

(54) APPARATUS FOR ICE-MAKING AND CONTROL METHOD FOR THE SAME

(75) Inventors: Young Jin Kim, Seoul (KR); Hong Hee Park, Seoul (KR); Kwang Ha Suh, Seoul (KR); Tae Hee Lee, Seoul (KR); Joon Hwan Oh, Seoul (KR)

(73) Assignee: LG Electronics Inc., Seoul (KR)

( * ) Notice: Subject to any disclaimer, the term of this patent is extended or adjusted under 35 U.S.C. 154(b) by 887 days.

(21) Appl. No.: 12/521,051

(22) PCT Filed: Nov. 15, 2007

(86) PCT No.: PCT/KR2007/005738

§ 371 (c)(1),
(2), (4) Date: Jun. 24, 2009

(87) PCT Pub. No.: WO2008/082071

PCT Pub. Date: Jul. 10, 2008

(65) Prior Publication Data

US 2010/0018226 A1 Jan. 28, 2010

(30) Foreign Application Priority Data

Dec. 31, 2006 (KR) ..... 10-2006-0139245

(51) Int. Cl.
*F25C 5/08* (2006.01)

(52) U.S. Cl. ..... 62/73; 62/351; 62/352

(58) Field of Classification Search ..... 62/73, 351, 62/352

See application file for complete search history.

(56) References Cited

U.S. PATENT DOCUMENTS

| | | | | |
|---|---|---|---|---|
| 5,056,321 | A * | 10/1991 | Patrick | 62/73 |
| 5,182,916 | A | 2/1993 | Oike | |
| 6,357,720 | B1 * | 3/2002 | Shapiro et al. | 249/119 |
| 6,647,739 | B1 * | 11/2003 | Kim et al. | 62/352 |
| 6,935,124 | B2 * | 8/2005 | Takahashi et al. | 62/74 |
| 2002/0083726 | A1 * | 7/2002 | Kim et al. | 62/137 |
| 2006/0086135 | A1 * | 4/2006 | Wu et al. | 62/351 |
| 2006/0272340 | A1 * | 12/2006 | Petrenko | 62/73 |
| 2007/0101753 | A1 * | 5/2007 | Broadbent | 62/349 |

FOREIGN PATENT DOCUMENTS

| | | |
|---|---|---|
| JP | 04-028981 | 1/1992 |
| JP | 9-079718 | 3/1997 |
| JP | 2001-041623 | 2/2001 |
| RU | 2413142 C1 * | 2/2011 |

OTHER PUBLICATIONS

International Search Report dated May 21, 2008.

* cited by examiner

*Primary Examiner* — Ljiljana (Lil) V. Ciric
*Assistant Examiner* — Alexis Cox
(74) *Attorney, Agent, or Firm* — KED & Associates, LLP

(57) ABSTRACT

Ice maker including an ice making container (100) having a plurality of cavities (120) for forming ice, a heater body (210) on one side of the ice making container for selective generation of heat, and heating bars (220) each extended from the heater body to the cavity by a predetermined length with a profile in conformity with a bottom surface profile of the cavity (120) with a gap to the bottom surface such that the heating bar (220) is submerged under water in the cavity for causing a temperature gradient during ice making.

7 Claims, 3 Drawing Sheets

APPARATUS FOR ICE-MAKING AND CONTROL METHOD FOR THE SAME

TECHNICAL FIELD

The present invention relates to an ice maker and a method for controlling the same. More specifically, the present invention relates to an ice maker which can produce transparent ice by means of a simple structure effectively and a method for controlling the same.

BACKGROUND ART

In general, starting from refrigerators, the ice makers are used in water purifiers, vending machines, and ice making apparatuses (hereafter called as refrigerators and the like) for filling water in a container and freezing the water below a freezing point, to produce ice.

In producing ice with such ice makers, in the refrigerator and the like, water is supplied to the ice maker, and cold air is supplied to the ice maker, to cool the water filled in the ice maker down below a freezing point, to form the ice.

DISCLOSURE OF INVENTION

Technical Problem

However, if a process for forming the ice is reviewed, the process has a problem in that a quality of the ice produced thus is very poor due to bubbles locked under a surface of the water because density of the water varies in the cooling process of the water filled in an ice making container (the density of the water is the highest at 4° c., and lower at a temperature below 4° c.), leading the water at a temperature below 4° c. to float to the surface of the water due to a density difference and to freeze the water starting from the surface to downward, failing to discharge bubbles to an outside of the water, but locking the bubbles under the water surface.

Technical Solution

To solve the problem, an object of the present invention is to provide an ice maker and a method for controlling the same, which can produce transparent ice by means of a simple method, effectively.

To achieve these objects and other advantages and in accordance with the purpose of the invention, as embodied and broadly described herein, an ice maker includes an ice making container having a plurality of cavities for forming ice, a heater body on one side of the ice making container for selective generation of heat, and heating bars each extended from the heater body to the cavity by a predetermined length with a profile in conformity with a bottom surface profile of the cavity with a gap to the bottom surface such that the heating bar is submerged under water in the cavity for causing a temperature gradient during ice making.

The heating bar includes a supporting portion connected to the heater body, and a curved portion extended from the supporting portion, with a curve in conformity with the bottom surface profile of the cavity.

Or, alternatively, the heating bar includes a supporting portion connected to the heater body, and a heating plate of a predetermined area extended from the supporting portion, with a curve in conformity with the bottom surface profile of the cavity.

The heating plate includes a shape the same shape with a shape of entire or a portion of a cross section of the cavity, substantially.

The ice maker further includes an ejector mounted not to interfere with the heating bars during rotation thereof for ejecting the ice from the cavity.

The heating bar includes a depth from the water surface to a lowest point of the heating bar submerged under the water to be 20% to 100% of a depth of the water from the water surface in the cavity to a bottom of the cavity, substantially.

The heating plate includes a half heating plate having a shape the same with a substantially half of a cross section of the cavity.

Or, alternatively, the heating plate includes a half circular heating plate having a shape substantially the same with a shape of a cross section of the cavity.

The ice maker further includes a water supply unit for supplying water to the cavity, an ice making detector for performing at least one of temperature sensing of the water in the cavity and sensing a ice making time period, and a control unit connected to the water supply unit, the ejector, and the ice making detector for controlling a procedure starting from water supply to ice ejection.

In another aspect of the present invention, a method for controlling an ice maker includes the steps of supplying water to cavities in an ice making container, controlling a heater to transfer heat to the water in the cavities for causing a temperature gradient in the water in a process of ice making, and determining finish of the ice making and ejecting the ice from the cavities.

The step of controlling a heater includes the step of selective application of a voltage to the heater within a predetermined range to vary a heating capacity, for increasing an ice making rate.

The step of controlling a heater includes the step of selective turning on/off of power to the heater in regular intervals to vary a heating capacity, for increasing an ice making rate.

The step of determining finish of the ice making includes the step of sensing a temperature of the water in the cavity or a time period required for the ice making with an ice making detector and, if the control unit determines that the ice making is finished, the control unit putting an ejector into operation.

Advantageous Effects

The present invention has following advantageous effects.

The ice maker and the method for controlling the same of the present invention permit to produce transparent ice by a simple method, effectively.

BRIEF DESCRIPTION OF THE DRAWINGS

The accompanying drawings, which are included to provide further understanding of the disclosure and are incorporated in and constitute a part of this application, illustrate embodiments of the disclosure and together with the description serve to explain the principle of the disclosure.

In the drawings.

MODE FOR THE INVENTION

Reference will now be made in detail to the specific embodiments of the present invention, examples of which are illustrated in the accompanying drawings. Wherever possible, the same reference numbers will be used throughout the drawings to refer to the same or like parts.

Figure 1:
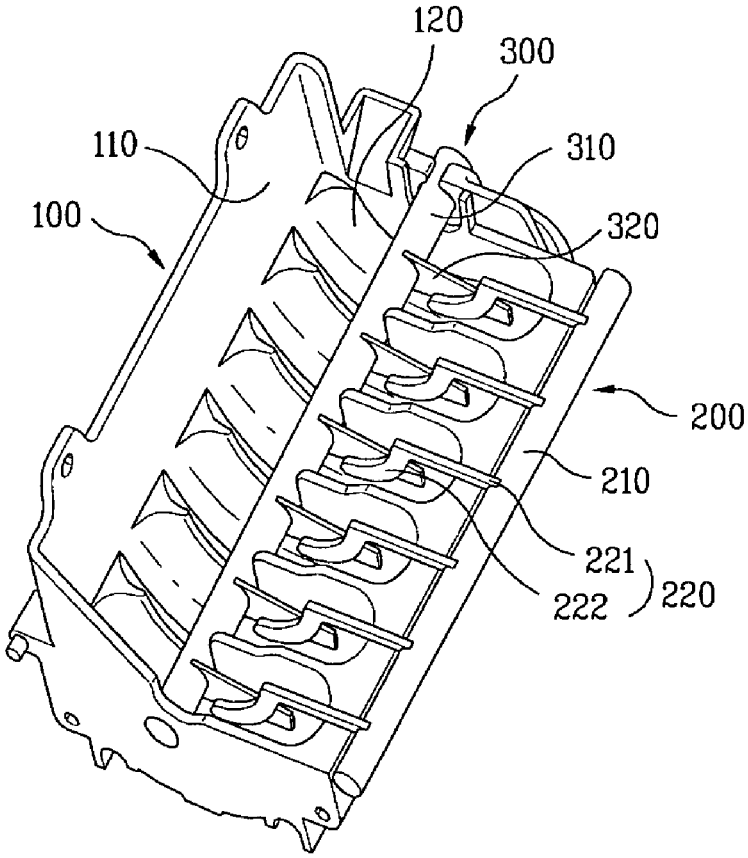
FIG. 1 illustrates a perspective view of an ice making container and a heater of an ice maker in accordance with a preferred embodiment of the present invention.

Referring to FIG. 1, the ice maker of the present invention includes an ice making container 100 for making to produce ice, a heater 200 on one side of the ice making container 100 for enabling production of transparent ice, and an ejector 300 for ejecting the ice from the ice making container 100.

The ice making container 100 includes a body 110 which forms an exterior of the ice maker, and a plurality of cavities 120 in the body 110 each having a predetermined size for holding the water to produce the ice.

Though cavity may have a variety of shapes, it is preferable that a bottom of the cavity 120 is curved substantially for separating the ice by rotating the ejector 300.

The heater 200 includes a heater body 210 on one side of the body 110 of the ice making container 100 for generating heat by any one of means, such as electricity, and heating bars 220 each extended from the heater body 210 to the cavity 120 by a predetermined length provided in the cavity. The heating bar 220 includes a supporting portion 221 extended from the heater body 210 toward the cavity 120, and a curved portion 222 supported on the supporting portion 221 and extended from the supporting portion 221 to an inside of the cavity 120 by a predetermined length.

The curved portion 222 has a shape substantially the same with the shape of a bottom surface of the cavity 120, such that the portion of the heating bar 220 under the water in the cavity 120 has a curved shape in conformity with the bottom surface of the cavity 120 starting from the water surface by a predetermined length.

The ejector 300 includes a shaft 310 rotatably mounted substantially at a center of the ice making container 100, and rotatable members 320 each extended from the shaft 310 toward an upper side of the cavity 120 for separating and ejecting the ice produced in the cavity 120 by rotation. The rotatable member 320 is provided not to overlap with the heating bar 220, so that the rotatable member 320 does not interfere with the heating bar 220 when the rotatable member 320 rotates, for smooth rotation of the rotatable member 320.

It is preferable that a control unit (not shown) is provided for controlling the heater 200 and the ejector 300 in production of the transparent ice.

Figure 2:
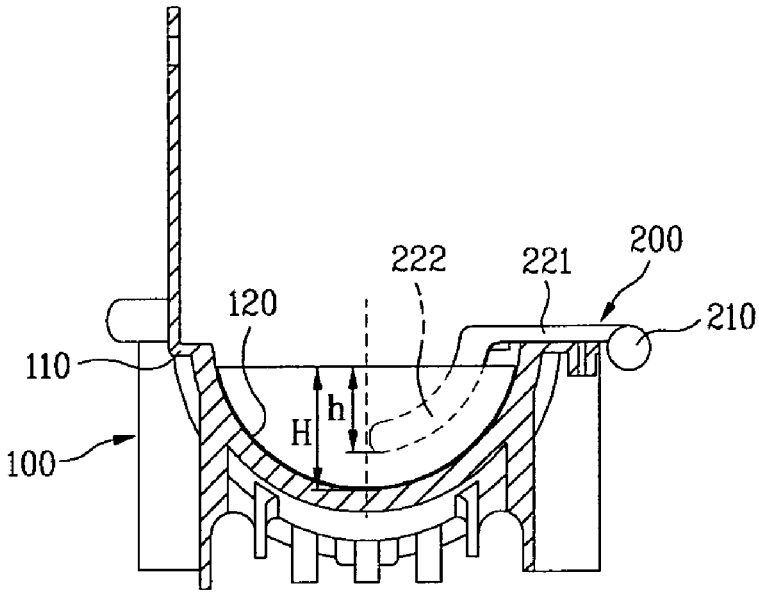
FIG. 2 illustrates a section of an ice maker in accordance with a preferred embodiment of the present invention.

In the meantime, referring to FIG. 2, the heater body 210 is on one side of the body 110 of the ice making container 100, and the supporting portion 221 and the curved portion 222 are extended from the heater body 210 toward the cavity 120.

The curved portion 222 has a predetermined thickness and width. Though the curved portion 222 is the better if the thickness of the curved portion 222 is the smaller, but it is required that the thickness is enough to transmit heat from the heater body 210 adequately, and also the width of the curved portion 222 is enough to transmit heat from the heater body 210 adequately.

In the meantime, referring to FIG. 2, one factor more important than the width of the curved portion 222 is an extent of the curved portion 222 to be submerged under the water. As shown in FIG. 2, if it is assumed that a depth from the water surface in the cavity 120 to a bottom of the cavity 120 is H, and a depth from the water surface to a lowest point of the curved portion 222 submerged under the water is h, a key of formation of the transparent ice lies on a ratio of h/H.

According to experiments, it is determined that the transparent ice is formed when the ratio h/H is in a range of 20%~100%. Since there are no particular criteria for determination of the transparent ice, but the determination of the transparent ice can only be made with naked eyes, it is impossible to formulate an experimental graph, or the like.

In the meantime, an operation principle of the heater 200 for forming the transparent ice will be described. If the water in the cavity 120 starts to cool down with external cold air and heat is transferred from the heater 200 to the water in the cavity through the curved portion 222, a temperature gradient takes place in the water in the cavity 120 during the ice is made.

That is, the temperature is relatively high at a place around the curved portion 222, and the temperature becomes the lower as it goes the farther from the curved portion 222, such that formation of the ice starts from a place the farthest from the curved portion 222, to expel bubbles formed at this time to a region where the ice is not being formed around the curved portion 222. As time passes by, as formation of the ice is progressed at a region having a relatively low temperature, the bubbles are expelled to the place around the curved portion 222 to form the transparent ice gradually, and as time passes further, the formation of the ice is done even up to a region where the curved portion 222 is in a state all the bubbles are expelled from the cavity 120, to form perfect transparent ice.

In this instance, it is preferable that the heat from the curved portion 222 is transmitted to the water in the cavity 120 uniformly, a factor of determination of which is the very submerged depth of the curved portion 222, i.e., the deeper the h, the more uniform the distribution of the heat, to form good quality transparent ice. It is described already that it is preferable that h/H is in the range of 20%~100%.

The operation for forming the transparent ice and ejection of the ice will be described with reference to FIGS. 3 and 4.

Figure 3:
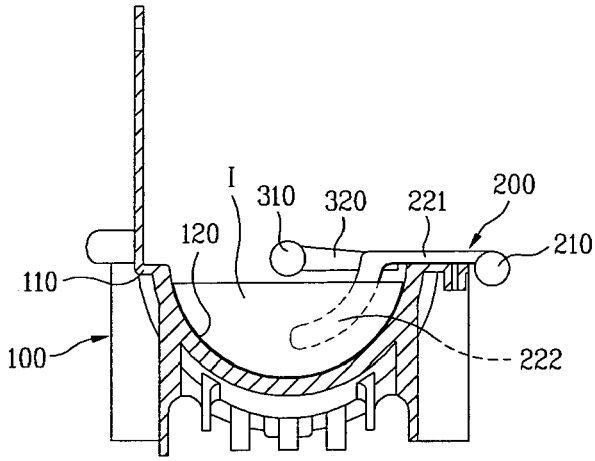
FIGS. 3 and 4 illustrate diagrams showing operation of an ice maker in accordance with a first preferred embodiment of the present invention, respectively.
Figure 4:
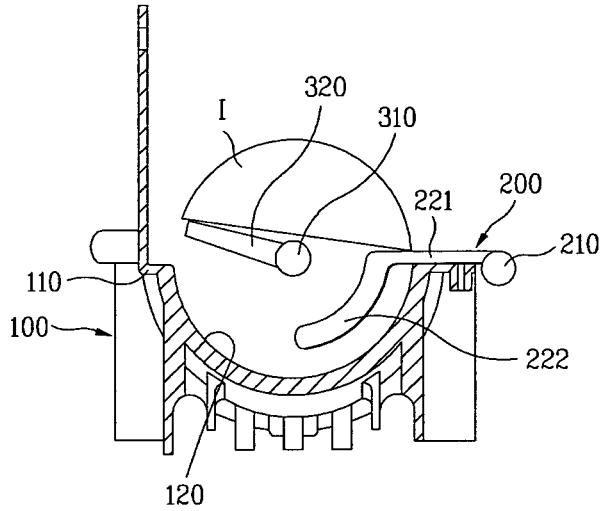

Referring to FIG. 3, if the cavity 120 of the ice making container 100 has the water filled therein (which is supplied from a water supply unit that is not shown), and the heater 200 is put into operation, the heat is transferred from the heater body 210 to the curved portion 222, and therefrom to the water in the cavity 120. In this instance, the external cold air is supplied, continuously.

The heat transfer from the curved portion 222 forms the temperature gradient in the water in the cavity 120, and as time passes by, to form the transparent ice. In this instance, though not shown, an ice making detector (not shown) provided to the ice maker detects if the ice making is finished or not. The ice making detector (not shown) may make the control unit to determine the finish of the ice making either with temperature sensing of a temperature sensor (not shown) at one side of the cavity 120, or sensing a preset ice making time period based on experimental data on a time period required for the ice making, or both.

If the ice making is finished thus, the control unit puts the ejector 300 into operation, wherein, as the shaft 310 is rotated, the rotatable member 320 rotates in a clockwise direction when the drawing is seen from above, when a certain extent of melting of the ice in the vicinity of a surface of the curved portion 222 in the ice by the heat transferred thereto to a certain extent from the curved portion 222 enables easy ejection of the ice. According to this, as shown in FIG. 4, as the rotatable member 320 rotates in the clockwise direction, the ice is ejected.

In the meantime, with regard to the ice makers in accordance with the second and the third preferred embodiments of the present invention, matters related to the body 110, the cavity 120, and so on of the ice making container 100 are the same with things shown in FIGS. 1 and 2, and matters on the shaft 310 and the rotatable member 320 of the ejector 300 are also the same.

Figure 5:
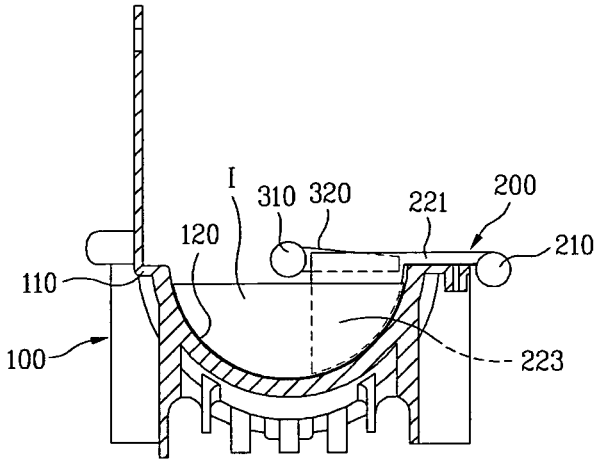
FIG. 5 illustrates a diagram of an ice maker in accordance with a second preferred embodiment of the present invention.
Figure 6:
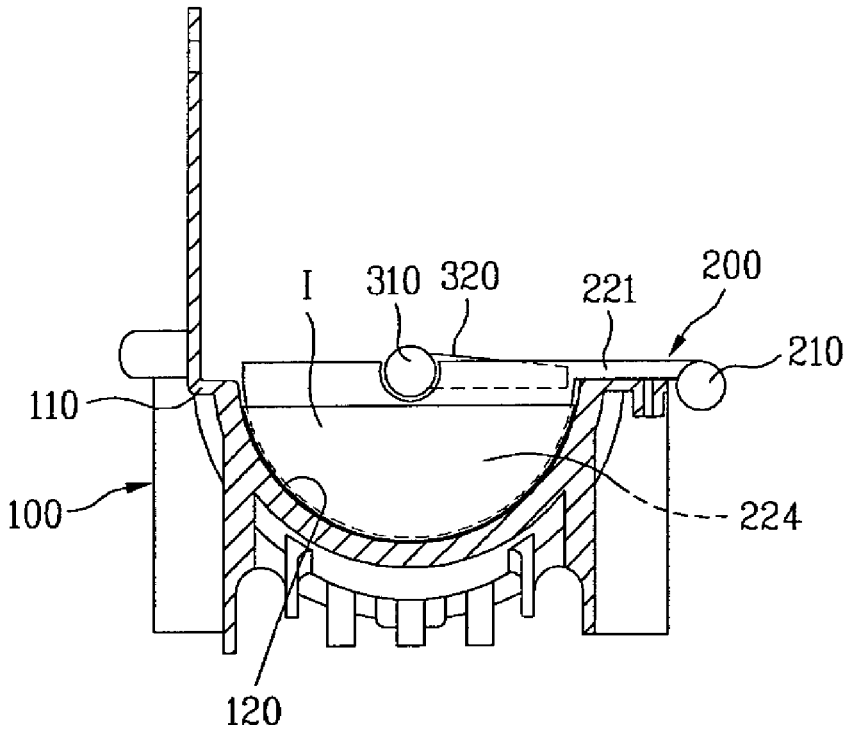
FIG. 6 illustrates a diagram of an ice maker in accordance with a third preferred embodiment of the present invention.

The ice makers in accordance with the second and the third preferred embodiments of the present invention shown in FIGS. 5 and 6 have a difference in the heater 200, specifically, heating bar, from the foregoing embodiment.

Referring to FIG. 5, the heater 200 applied to the ice maker in accordance with the second preferred embodiment of the present invention includes a heater body 210, a supporting portion 221 extended from the heater body 210, and a half heating plate 223 extended downward from the supporting portion 221 so as to be submerged under the water in the cavity 120.

The half heating plate 223 has a section one half of a longitudinal section (a section in FIG. 5) of the cavity 120 substantially, with a lower edge profile the same with a bottom profile of the cavity 120 substantially. The half heating plate 223 is different from the curved portion 222 (see FIG. 2) in FIGS. 2, 3 or 4 in shape, but the same in function or purpose. Therefore, it is preferable that a depth of the half heating plate 223 from the water surface of the cavity 120 to a lower edge of the half heating plate 223 is 20%~100% of a depth of the cavity 120 from the water surface of the cavity 120 to the bottom surface of the cavity 120, substantially.

The half heating plate 223 in FIG. 5 has a comparably large area enabling to reduce thickness thereof more or less, permitting to increase degrees of mounting freedom of the rotatable member 320 of the ejector 300. That is, there can be more room space which permits the rotatable member 320 to be mounted without interfering with the half heating plate 223.

Referring to FIG. 6, the heater 200 applied to the ice maker in accordance with the third preferred embodiment of the present invention includes a heater body 210, a supporting portion 221 extended from the heater body 210, and a half circular heating plate 224 extended downward from the supporting portion 221 so as to be submerged under the water in the cavity 120.

The half circular heating plate 224 has a section the same with a longitudinal section (a section in FIG. 6) of the cavity 120 substantially, with a lower edge profile the same with a bottom profile of the cavity 120 substantially. The half circular heating plate 224 is different from the curved portion 222 (see FIG. 2) in FIGS. 2, 3 or 4 in shape, but the same with the curved portion 222 (see FIG. 2) in function or purpose. Therefore, it is preferable that a depth of the half circular heating plate 224 from the water surface of the cavity 120 to a lower edge of the half circular heating plate 224 is 20%~100% of a depth of the cavity 120 from the water surface of the cavity 120 to the bottom surface of the cavity 120, substantially.

The half circular heating plate 224 in FIG. 6 has a comparably large area enabling to reduce thickness thereof more or less, permitting to increase degrees of mounting freedom of the rotatable member 320 of the ejector 300. That is, there can be more room space which permits the rotatable member 320 to be mounted without interfering with the half circular heating plate 224. if formation of the ice is done with the half circular heating plate 224, the ice produced in the cavity 120 is divided by the half circular heating plate 224. Therefore, it is preferable that the half circular heating plate 224 is mounted across a center of the cavity 120. The ice produced with the half circular heating plate 224 is clearer without dent or hole than the ice produced with the curved portion 222 (see FIG. 2) or the half heating plate 222 (see FIG. 5). That is, if the ice produced with the curved portion 222 (see FIG. 2) or the half heating plate 222 (see FIG. 5), though a shape of the curved portion 222 (see FIG. 2) or the half heating plate 222 (see FIG. 5) is left in the ice to form a dent or a hole, if the ice is produced with the half circular heating plate 224 to divide the ice by halves clearly, such a problem can be resolved. However, if it is intended to obtain ice clearer as above, it is preferable that a lower edge of the half circular heating plate 224 is in contact with, or very close to, the bottom surface of the cavity 120.

The steps of a method for controlling an ice maker in accordance with a preferred embodiment of the present invention will be described, with reference to FIG. 7.

Figure 7:
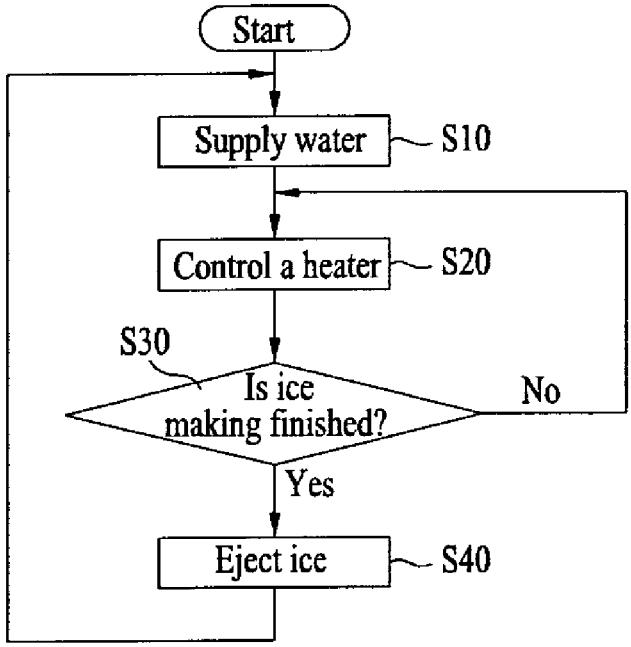
FIG. 7 illustrates a flow chart showing the steps of a method for controlling an ice maker.

Referring to FIG. 7, water is supplied to the cavity (S10), when cold air is supplied to the ice maker from an outside thereof. As the formation of ice is progressed with the cold air after the water supply, the control unit controls the heater (S20). That is, the control unit puts the heater into operation to form a temperature gradient in the water, for forming transparent ice. Since the heater generates heat, a rate of the ice formation is liable to become slow. Therefore, the control unit controls to vary a capacity of the heater, to improve the rate of ice formation.

The control of the heater is made in two methods. First, the control unit controls a voltage of a preset range to be applied to the heater within the preset range selectively for making the rate of the ice formation faster, or second, the control unit controls a time period of application of power for making a heating time period of the heater to be within a certain range of time period, to improve the rate of ice formation.

For an example, if the voltage to the heater is around 3V~12V, since fast progress of the ice formation is important at an initial stage of the ice formation, the voltage is applied starting from 3V, and raises the voltage slower, so that the heater also is heated weakly, and then is heated up slowly. Then, after raising the voltage to the maximum at a certain time point, the voltage is dropped slowly as a time point to finish the ice formation comes closer, to make easy finish of the ice formation. In the second method control, for an example, the heater may be controlled by repeating turning on of the heater for five seconds with ½power, and then turning off the heater for five seconds.

After the heater control step (S20), the control unit determines whether the ice formation is finished or not (S30). The determination of finish of the ice formation is made with an ice making detector. The ice making detector (not shown) may make the control unit to determine the finish of the ice making either with temperature sensing of a temperature sensor (not shown) at one side of the cavity 120, or sensing a preset ice making time period based on experimental data on a time period required for the ice making, or both.

If it is determined that the ice making is not finished in the step of S30, the process returns to the step of S20, and if it is determined that the ice making is finished in the step of S30, the control unit puts the ejector into operation, to eject the ice (S40).

Industrial Applicability

The ice maker and the method for controlling the same of the present invention have industrial applicability of enabling to produce transparent ice by a simple method, effectively.

The invention claimed is:

1. An ice maker, comprising:

An ice making container having a plurality of cavities configured to receive water to be frozen into ice by cold air supplied to the ice making container, and each cavity having a cross section in the shape of a half circle;

A heater body provided at one side of the ice making container for selective generation of heat; and, A plurality of heating bars, each of said plurality of heating bars extending from the heater body into a respective cavity of the plurality of cavities by a predetermined length, Each of said plurality of heating bars comprising a supporting portion connected to the heater body, Each of said plurality of heating bars further comprising a bent portion extending from the supporting portion, wherein the shape of the bottom of each bent portion conforms to the shape of the bottom of the respective cavity into which the heating bar extends with a gap formed between each curved portion and the bottom surface of the respective cavity, the plurality of heating bars generating heat as the cold air is supplied to the ice making container so as to generate a temperature gradient in the water received in the ice making container during ice making.

2. An ice maker, comprising:

An ice making container having a plurality of cavities configured to receive water to be frozen into ice by cold air supplied to the ice making container, each of said plurality of cavities having a cross section in the shape of a half circle;

A heater body provided at one side of the ice making container for selective generation of heat; and A plurality of heating bars, each of the plurality of heating bars extending from the heater body into a respective cavity of the plurality of cavities by a predetermined length, Each of said plurality of heating bars comprising a supporting portion connected to the heater body, Each of said plurality of heating bars further comprising a heating plate extending from the supporting portion, the heating plate having a curved bottom edge that conforms to the shape of the bottom of the respective cavity into which the heating bar extends with a gap formed between each heating plate and the bottom surface of the respective cavity, the plurality of heating bars generating heat as the cold air is supplied to the ice making container to generate a temperature gradient in the water received in the ice making container during ice making.

3. The ice maker as claimed in claim 1, further comprising an ejector rotatably coupled to the ice making container for ejecting the ice from the plurality of cavities, wherein the ejector is positioned such that the ejector does not interfere with the plurality of heating bars during rotation of the ejector.

4. The ice maker as claimed in claim 1, wherein a depth from a top surface of the water received in each of the plurality of cavities to a lowest point of the plurality of heating bars respectively submerged under the water is at least 20% of a depth of from the top surface of the water to the bottom surface of the deepest point of the respective cavity.

5. The ice maker as claimed in claim 2, wherein the heating plate comprises a half heating plate having a shape that corresponds to half of the cross section of the respective cavity along the plane of the heating plate.

6. The ice maker as claimed in claim 2, wherein the heating plate comprises a half circular heating plate having a shape that corresponds to the cross section of the respective cavity along the plane of the heating plate.

7. The ice maker as claimed in claim 3, further comprising:

a water supply unit for supplying water to the plurality of cavities;

an ice making detector for performing at least one of temperature sensing of the water received in the plurality of cavities or sensing an ice making time period; and a control unit connected to the water supply unit, the ejector, and the ice making detector for controlling a procedure starting from water supply to ice ejection.

* * * * *